United States Patent [19]

Meier

[11] Patent Number: 4,941,798

[45] Date of Patent: Jul. 17, 1990

[54] MEANS FOR MANIPULATING AND TRANSPORTING LOADS

[75] Inventor: Jacques Meier, Bäretswil, Switzerland

[73] Assignee: SFT AG Spontanfördertechnik, Weinfelden, Switzerland

[21] Appl. No.: 250,250

[22] Filed: Sep. 27, 1988

[30] Foreign Application Priority Data

Oct. 13, 1987 [CH] Switzerland ..... 03998/87

[51] Int. Cl.[5] ..... B66F 9/18; B65H 29/00; B66C 1/24

[52] U.S. Cl. ..... 414/619; 414/626; 414/684; 414/738; 414/783; 414/908; 414/910; 414/911; 294/93

[58] Field of Search ..... 414/607, 618, 619, 620, 414/626, 680, 684, 729, 738, 772, 776, 783, 908, 910, 911; 294/93

[56] References Cited

U.S. PATENT DOCUMENTS

| | | | |
|---|---|---|---|
| 2,207,893 | 7/1940 | Nash et al. | 414/776 |
| 2,817,450 | 12/1957 | Ulinski | 414/620 |
| 2,841,301 | 7/1958 | Sherriff | 414/908 X |
| 2,931,530 | 4/1960 | Arnot . | |
| 2,964,205 | 12/1960 | Ulinski . | |
| 2,972,427 | 6/1958 | Quayle . | |
| 2,984,985 | 5/1961 | MacMillin | 414/620 X |
| 3,128,118 | 4/1964 | Ezzell | 414/626 X |
| 3,195,444 | 7/1965 | McLean | 414/684 X |
| 3,240,356 | 3/1966 | Hill | 414/684 X |
| 3,786,948 | 1/1974 | Golden | 414/684 |
| 3,958,704 | 5/1976 | Wire et al. | 414/684 X |
| 4,154,470 | 5/1979 | Daglish | 414/684 X |
| 4,322,198 | 3/1982 | Zuber | 414/772 X |
| 4,358,143 | 11/1982 | Cullen | 414/911 X |
| 4,549,845 | 10/1985 | Ramsey, Jr. | 414/680 X |
| 4,557,515 | 12/1985 | Read | 414/684 X |
| 4,681,505 | 7/1987 | Kobayashi et al. | 414/910 X |
| 4,687,244 | 8/1987 | Cullen et al. | 414/684 X |
| 4,708,574 | 11/1987 | Conboy et al. | 414/626 X |
| 4,821,972 | 4/1989 | Grollimund et al. | 414/908 X |

FOREIGN PATENT DOCUMENTS

| | | | |
|---|---|---|---|
| 341140 | 9/1921 | Fed. Rep. of Germany . | |
| 149166 | 11/1979 | Japan | 414/910 |
| 1293796 | 10/1972 | United Kingdom . | |

*Primary Examiner*—Robert J. Spar
*Assistant Examiner*—Robert S. Katz
*Attorney, Agent, or Firm*—Walter C. Farley

[57] ABSTRACT

The inventive manipulator for heavy loads, preferably printing products in loose scale formation and wound up to form rolls, only has a single pivot pin (35) or joint which, according to the invention, is arranged in such a way that the load (5) can be brought into three main positions orthogonal to one another using this single pivot pin or joint. The load is held by a holding device (33,38). The pivot pin (35) passes through the center of gravity of the load, or the center of gravity is located in the pivot point or fulcrum. This makes it possible to grip in frontal or lateral precise manner heavy loads and subsequently to deposit same on a loading device or in a store without great force expenditure using a drive and/or manually. The invention is also characterized by the combination of an industrial truck (10), a lifting device (11) arranged thereon and a mounted implement (31–38) located on the truck and preferably constituted by the inventive manipulator.

9 Claims, 10 Drawing Sheets

MEANS FOR MANIPULATING AND TRANSPORTING LOADS

The present invention relates to a manipulator, particularly for industrial trucks and cranes.

The invention also relates to an industrial truck, particularly for manipulating and transporting printing product rolls in the printing industry.

BACKGROUND OF THE INVENTION

Industrial trucks, cranes and lifting tackle of the most varied types and with the most varied mounted implements are known for manipulating and transporting heavy objects. Generally they have a vertical guide structure or rail structure for a lifting fork or other manipulating means or load carriers, such as shovels, bars, pincer grippers, etc. For fork lift trucks there are also special mounted implements and these are available in many different forms and for many different purposes, so as to increase the number of possible manipulations. The sought possibilities are generally achieved with such mounted implements and due to the vast number of different uses and requirements for the individual manipulations, it is necessary to provide a corresponding, problem-adapted mounted implement. A fork lift truck equipped with a manipulator is always in the position to "grip" the object, e.g. a container to be manipulated and to bring it to the desired point, where it can be deposited or only emptied.

However, problems occur if the particular object not only has to perform translatory movements, but is also to be rotated and in this way brought into other spatial positions. For such purposes e.g. rotary means, turn-a-load pallet turning means and rotary gripping clips are known. However, these manipulators suffer from the disadvantage that the loads are essentially only rotated about an axis parallel to the direction of travel of the truck. Normally there are clips or claws arranged in such a way that the centre of gravity of the load to be rotated is located on the rotation axis or fulcrum. This concept leads to problems if, during the handling of heavy loads which e.g., as a result of the characteristics of their surface, cannot be held on the outside by means of clips, the centre of gravity of the load is located alongside the rotation axis. Due to the lever arm, it is then possible for considerable forces to occur, which render impossible an accurate and rapid manipulation and constitutes a severe load for the bearings and joints. Moreover conventional manipulators do not make it possible for heavy loads to bring an e.g. circular cylindrical body into at least three given main positions without moving the truck where, as is desired in many cases, the axes of the circular cylinder are perpendicular to one another. In order to be able to bring a three-dimensional body into three such main positions use is made in other technical fields of means with three rotation axes which are vertical to one another and which correspondingly permit three degrees of freedom. In the case of uses under the aforementioned limit conditions, particularly the considerable weight of the loads to be manipulated, the requirement of long levers for rotary and bending movements, such as are e.g. known in the case of gripping arms of handling equipment in robot technology, as well as the need for rotational degrees of freedom and correspondingly complicated arrangements, would appear to be an obstacle which is unavoidable in connection with the wish for three main positions of the load to be rotated. Thus, conventional manipulators on industrial trucks generally use constructions with two rotational degrees of freedom with two axes at right angles to one another and it is necessary to accept the frequent movement of the truck for carrying out the third degree of freedom and also the massive constructions as a result of the forces which occur.

Similar problems occur in connection with the manipulation or handling of loads by means of cranes. A crane can e.g. be fixed or positioned on rails, or in less frequent cases can also be freely movable. In the industrial field frequent use is made of cranes with carriages. Particularly when using fixed cranes and cranes with rails or a carriage, the problem of the spatial rotation of loads is exacerbated, because no rotational degree of freedom can be obtained through moving the crane. In addition, the carrying cable is unable to take up torques.

In many applications heavy objects must be "gripped" from frames or e.g. production machines using such manipulators and deposited in intermediate or final storage places. Thus, particularly in the printing industry, a large number of printing products are wound onto the roll hub, said rolls then being manipulated and stacked in groups. The necessary manipulations generally involve the raising or gripping of standing rolls, i.e. the axis thereof is horizontal and the subsequent stacking of lying rolls (axis vertical). They are generally stored at a special point, so that a corresponding transportation path is involved. This procedure normally requires a large number of movements backwards and forwards, so that the use of several vehicles is made more difficult, because the travelling paths of the individual vehicles generally cross and therefore real traffic problems can occur. In addition, the path-/manipulation ratio in such operations is unfavourable, i.e. said work is more time and energy intensive than it should be. This problem can partly be reduced by organizational measures, but cannot be completely eliminated, because e.g. it is only possible to reduce the length of the path, but not the number of movements backwards or forwards. A subdivision of tasks between a manipulating means and a transportation means does not obviate the problem, because this would merely increase the traffic problem, because an additional means would have to be used.

SUMMARY OF THE INVENTION

An object of the present invention is to provide a means for the aforementioned purpose and in order to remove the aforementioned problems, which in particular permits the positioning of heavy loads in three main positions, which is very wear-resistant and inexpensive to manufacture, whilst also permitting manual handling.

It is a further object of the invention to provide an industrial truck making it possible to solve the logistic problems occuring during transportation and storage of heavy loads, such as the considerable time needed for the individual operations, long travel paths, reloading of loads, dismantling and in this way to permit a more rational and inexpensive handling and transportation of heavy loads.

The manipulator only has a single pivot pin or joint which, according to the invention, is arranged in such a way that the load can be brought with said single pivot pin or joint into two or three main positions orthogonal to one another, the pivot pin passing through the centre of gravity or of the load or the centre of gravity is located in the pivot point. This makes it possible to grip e.g. frontally or laterally even heavy loads and subsequently deposits same on the loading means or in the store without any great force expenditure.

The industrial truck (with or without rails) has a movable loading surface or a movable pallet lifting means, combined with a mounted implement for manipulating the load. Preferably the mounted implement is the inventive, movable manipulating or gripping means. The movable pallet means can contain a fork-like claw with an initial stroke and the movable manipulating and gripping means can have a receiving lug or pincers. As a result of the cooperation of said means at least part of the load to be conveyed is constantly carried by said industrial truck and if necessary can be deposited in the immediate vicinity thereof. This constant carrying along of a load during the collecting and manipulating of further loads is novel in the field of such industrial trucks. They are generally designed for short distance and single loading operation and do not have the possibility of self-loading and carrying along the load.

BRIEF DESCRIPTIONS OF THE DRAWINGS

Embodiments of the invention are now described relative to the drawings and the example of manipulating and transporting heavy printing product rolls. However, the manipulation and transportation of rolls is not the sole possible application of the means according to the invention. Most of the drawings show the means diagrammatically and in different working positions. Constructional details are, if necessary, only given if they are necessary for the Expert.

Figure 8A:
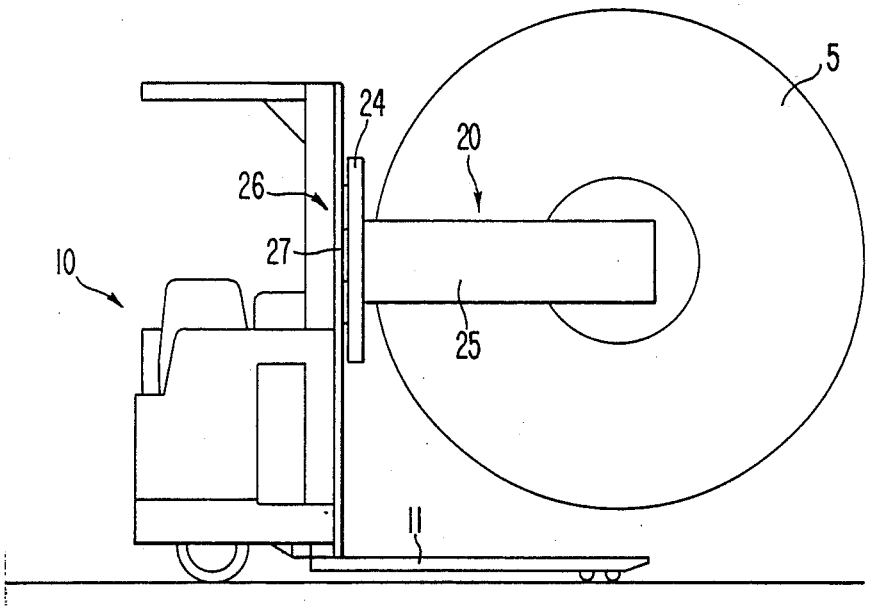
Figure 8B:
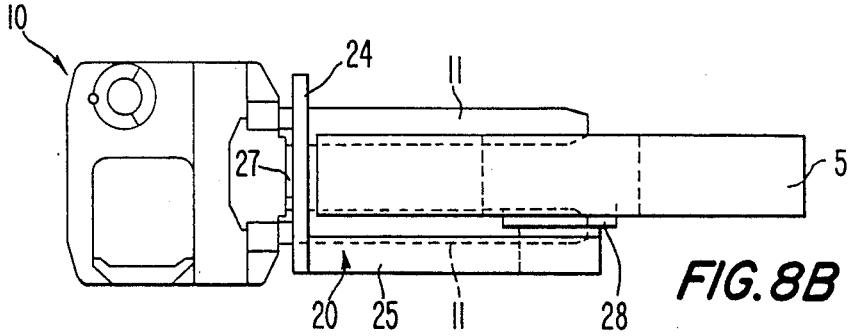
Figure 8C:
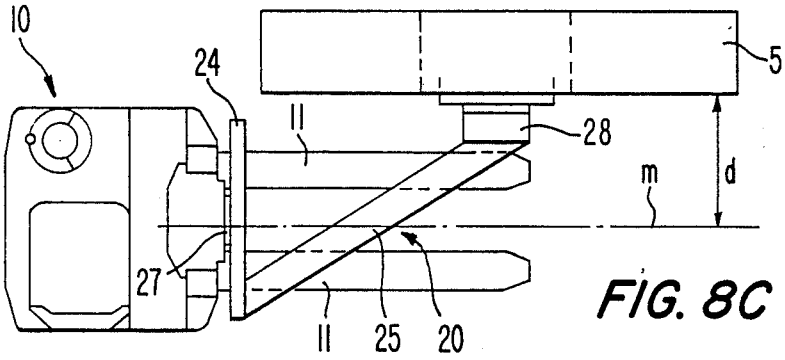

FIGS. 8A to 8C an inventive industrial truck with a combination of a mounted implement with pivotable weight arm and claws in different working positions.

Figure 9:
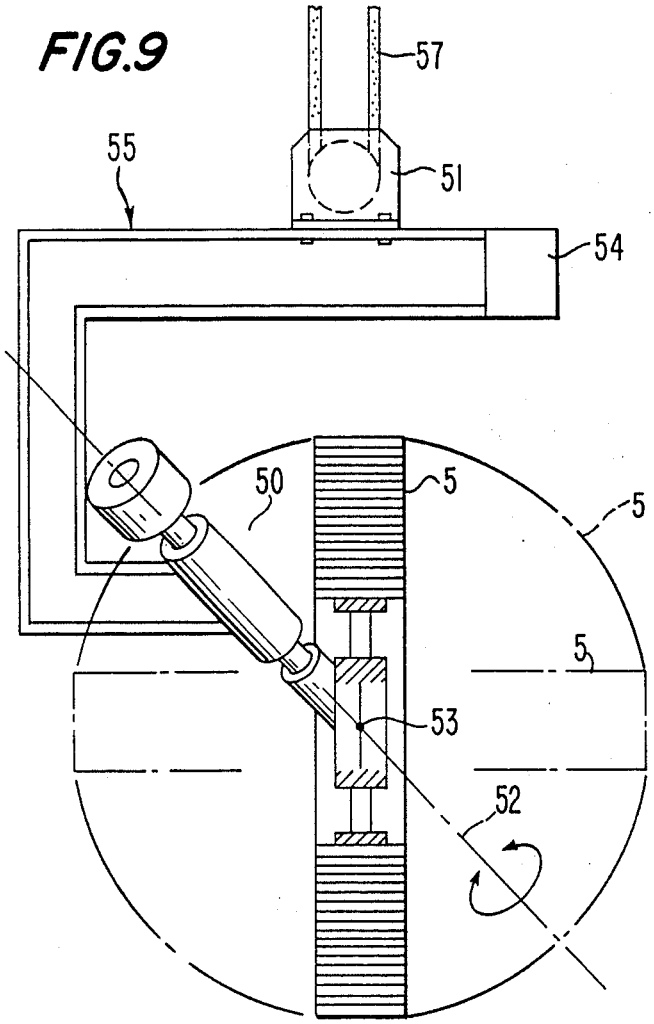

FIG. 9 shows the use of the manipulator for a crane.

Figure 10A:
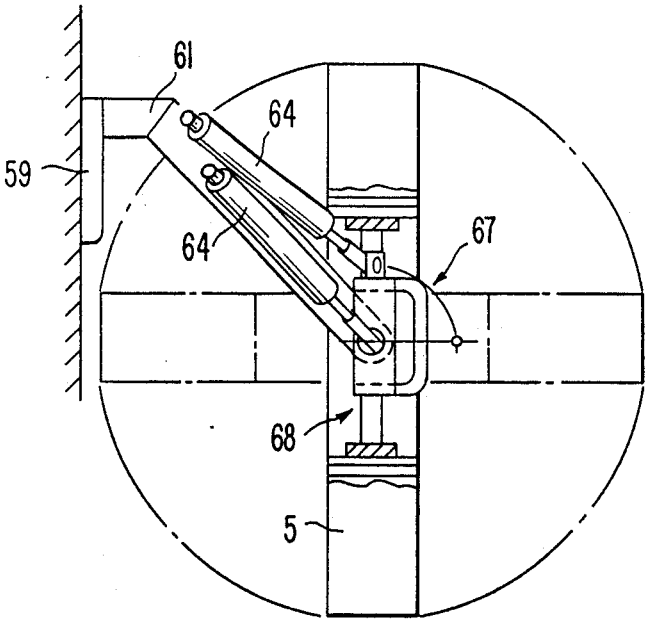
Figure 10B:
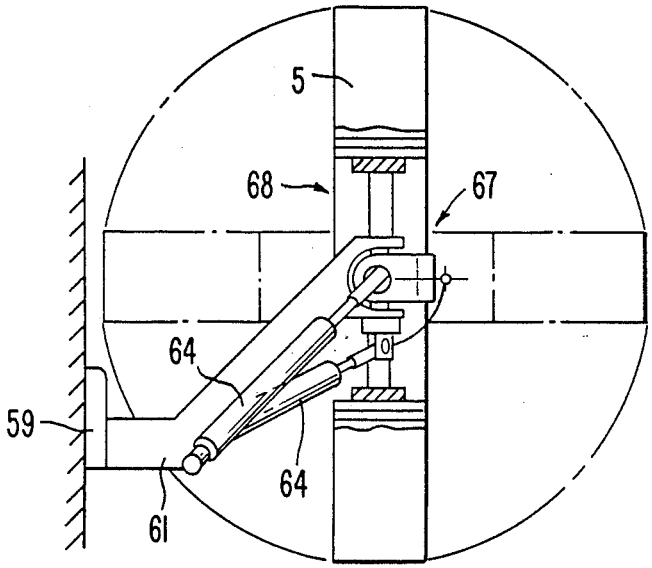

FIGS. 10A and 10B show an embodiment of the manipulator with a rigid support arm and a joint, as well as adjusting cylinders.

Figure 11A:
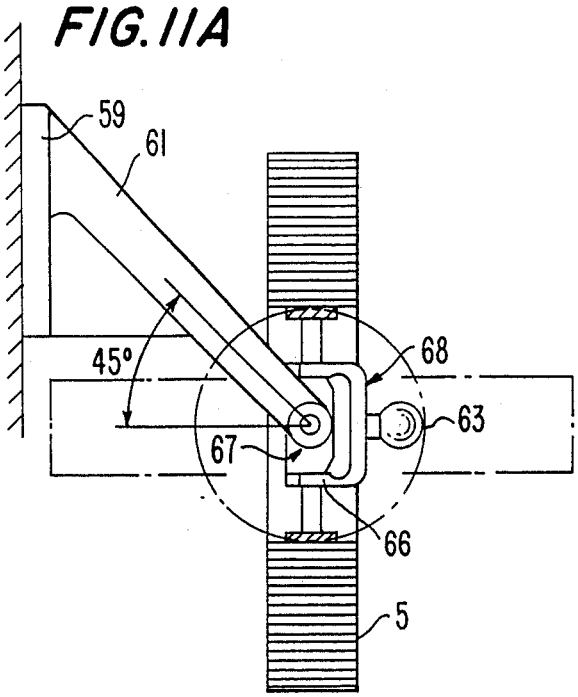
Figure 11B:
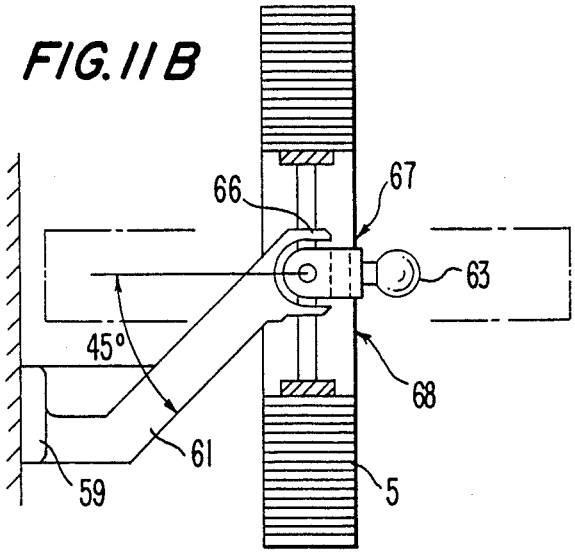

FIGS. 11A and 11B show an embodiment of the manipulator with a joint and a handle for manual actuation.

DESCRIPTION OF THE PREFERRED EMBODIMENT

Although the invention is mainly described herein relative to an industrial truck, it is obviously also possible to use inventive means in connection with a crane or other lifting or handling equipment. It is assume that the corresponding arrangement of such a manipulator is in each case adapted to the necessary working conditions, i.e. that the manipulator is arranged in such a way that the positions of the manipulated load attainable by the rotary movement are always spatially adequate.

The invention is based on the fact that conventional manipulators or working implements, i.e. industrial trucks, cranes etc., with which same can be used are on the one hand too complicated and on the other hand require time-consuming operations due to their limited degrees of freedom and their one-sided use possibilities. The handling of heavy loads is to be made easier and the necessary working processes optimized. Simultaneously the novel handling concept takes account of the space problem, which occurs in modern, confined stores with a high storage density. The invention permits a rationalization of the complete handling process with heavy loads and reduces logistic problems.

A principal use for the manipulator according to the invention is in the printing industry. The printed products discharged at high speed in the case of rotary printing are carried away from the press in scale formation, which has its own inherent order and generally attempts are made to retain this during intermediate storage. Thus, attempts are made to bring into a stationary state these printed products resting loosely upon one another in scale formation and at the full process speed and whilst retaining their reciprocal position, in such a way that it is then possible to re-establish the original scale flow. Such a procedure for the intermediate storage of printed articles occuring in scale formation comprises rolling up the incoming scale flow. These rolls are in due course to be further processable in unchanged manner generally weigh several hundred kilograms, so that special aids are required for the handling thereof, such as manipulation processes and equipment, as well as special storage methods. The present invention deals with this problem.

Figure 1:
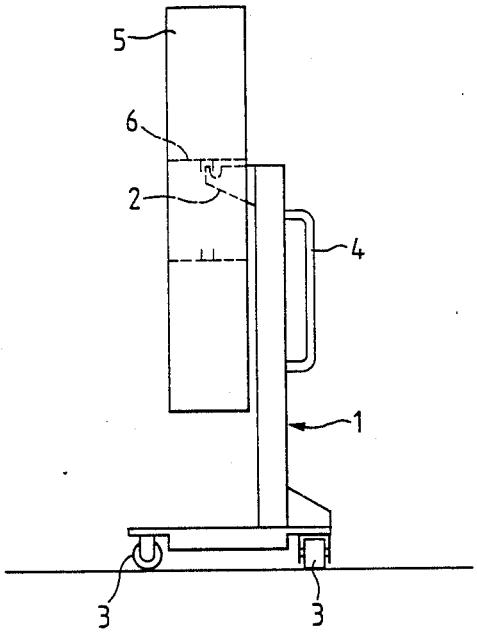
FIG. 1 shows a printing product roll weighing several hundred kilograms, which is on a support for taking away.

FIG. 1 shows such a printing product roll 5 wound onto a roll core 6 and which in the present case is suspended on a hook 2 on a support frame 1. The narrow side of roll 5 is shown. If given a quarter rotation , it would appear as a circular disk. The support frame also has casters 3 and a handle 4, so that the heavy roll can also be moved manually. The represented roll weighing e.g. 400 kg has been produced on the winding machine in the indicated position and has been subsequently hung on the support frame 1.

If it is now intended to store such rolls, whereby the flat sides of the rolls are placed on one another, then during the manipulation of the roll core 6 a rotation into the horizontal position is necessary. Thus, a manipulating means must be able to rotate such a roll into the desired, horizontal position. Often such rolls are also stored vertically, but sloping so as to lean against a wall, there being numerous rolls one behind the other. It is desirable that a manipulating means can grip said rolls both frontally and laterally, so that a vehicle with a manipulator fixed thereto can move past the rolls parallel to the support wall and by briefly stopping can in each case grip the front roll. Lateral gripping is also necessary if, for space reasons, the support frames are arranged in parallel, i.e. parallel gorges are formed into which it is possible to travel with the truck. In the case of confined space conditions the vehicle cannot turn in such gorges, so that lateral gripping is unavoidable. It should also be possible to frontally grip the rolls. In connection with such requirements it is obviously necessary that the manipulator permits at least three holding positions, whereby in accordance with the represented use example they must be essentially perpendicular to one another. The inventive concept is to provide a simple means, which permits these holding positions, whilst avoiding the obvious use of three rotation axes due to the level of complication and the technical problems of handling heavy loads.

Figure 2A:
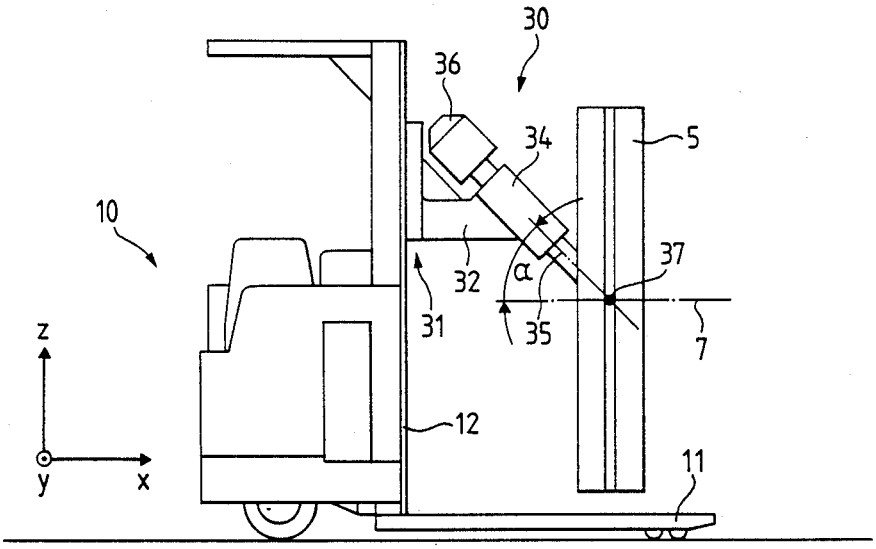
FIGS. 2A and 2B show an industrial truck with a manipulator according to the invention with a gripped roll from the side and from above.
Figure 2B:
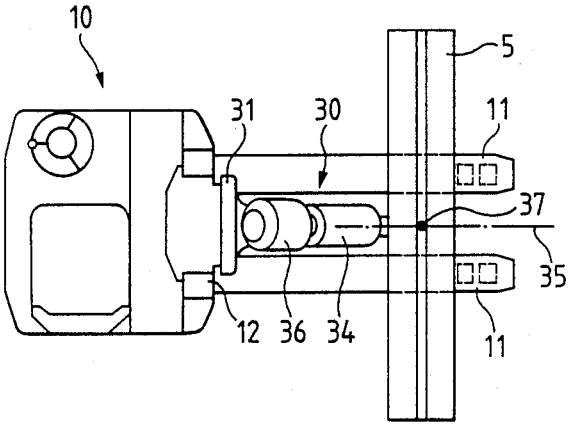

A first, simple embodiment of the invention permitting two holding positions is shown in FIGS. 2A and 2B. In order to be able to more simply describe the spatial movements a coordinate system is defined, which also applies to the following drawings and constructions. The corresponding axes are shown in FIG. 2A, the y-axis being perpendicular to the plane of the page and directed counter to the observer. In conventional manner the planes at right angles to the z-axis are called first principal planes, planes at right angles to the y-axis second principal planes and those at right angles to the x-axis third principal planes. Thus, truck 10 (related to its direction of travel) is parallel to a second principal plane and roll 5 in FIG. 2A is kept parallel to a third principal plane.

Manipulator 30 only has one pivot pin 35, which is located in a second principal plane and with respect to a third principal plane is inclined by 45° or slopes forwards and downwards from the truck 10. The manipulator is guided in a vertical rail 12 fitted to truck 10 by means of a lifting slide or carriage 31 and can be vertically adjusted. A receiving lug for roll 5, which forms the actual holding point for the same, is concealed by the latter in this representation. The pivot pin 35 is rotatably guided in a bearing 34 fixed to a support arm 32. The rotary drive is preferably provided by a hydraulic motor 36, which is e.g. directly arranged on one end of the pivot pin.

It is obviously possible to provide a different gripping or fixing means in place of a receiving lug for securing the load. The holding angle alpha between the pivot pin 35 and the roll 5 is 45° (related to the axis of the circular cylindrical roll). This holding angle remains unchanged during the rotation of pivot pin 35 and as a result roll 5 forms a spatial tumbling movement, i.e. its axis of symmetry 7 moves on the circumferential casing of a double cone with the apex in the gravity or holding point 37 and the pivot pin 35 as its axis of symmetry. It is apparent from this that following a rotation of pin or axle 35 by +180°, the roll comes into a position parallel to a first principal plane, i.e. is kept horizontal. It is possible in the same way to arrange the pivot pin horizontally under an angle of 45° to a third principal plane. This makes it possible to bring a roll from a frontal into a lateral holding position, which can e.g. be desirable for transfer from one frame to another.

Figure 3:
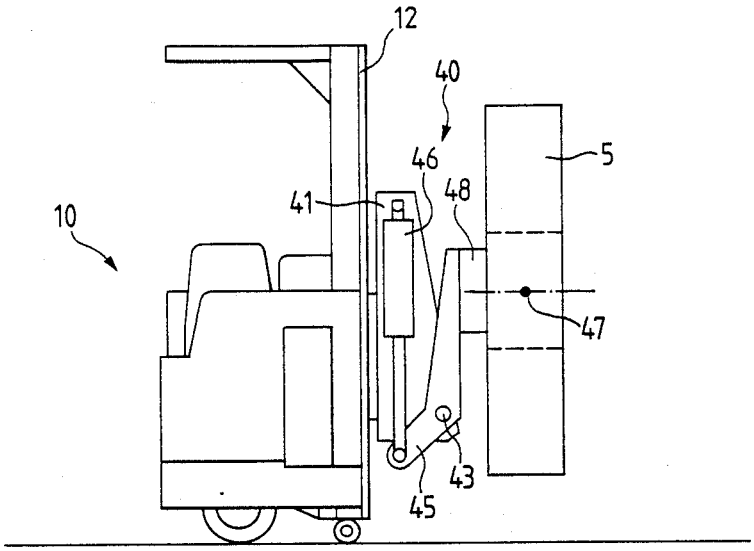
FIG. 3 shows a lateral view of a roll taken up by a conventional manipulator.

For comparison purposes, FIG. 3 shows a conventional mounted implement 40 in conjunction with an industrial truck 10. The mounted implement 40 essentially comprises a lifting slide 41, which as in FIG. 2 can be vertically adjusted on a vertical rail 12 fitted to truck 10 and to which is fitted, arranged on a swivel bearing 43, a rocker arm 45 operated by a hydraulic drive 46 and which is in turn provided with a receiving lug 48. With the latter the roll 5 can either be taken directly from the winding machine or from a support. The roll 5 resting on the rocker arm 45 and fixed to the receiving lug 48 can now be pivoted out of the represented vertical position into the horizontal position. As is clearly visible from this drawing, a pivoting of roll 5 about the swivel bearing 43 leads to considerable loading forces due to the spacing between the centre of gravity 47 and the swivel bearing 43 during such a movement. Obviously such a construction requires a very massive hydraulic drive, robustly constructed support members and bearings.

The problem of the invention of reducing logistic problems is taken into account by extending conventional industrial trucks by providing claws or other lifting means. The claws 11 shown in FIGS. 2A and 2B, in conjunction with the inventive manipulator, permit a completely novel use of the truck. The represented truck 10 is able, through the combination of claws and manipulator, to load a carried along pallet several printed product rolls, so that they can subsequently be transported to the desired storage location.

Figure 4A:
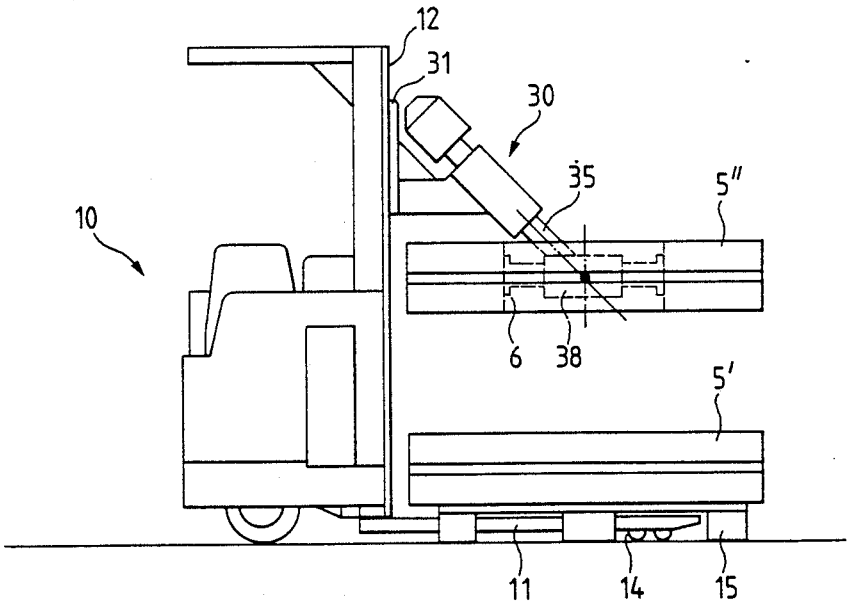
FIGS. 4A and 4B show the self-loading process of the means in side view and from above using an inventive manipulator, with which a further printing product roll is placed on a roll already carried by a pallet.
Figure 4B:
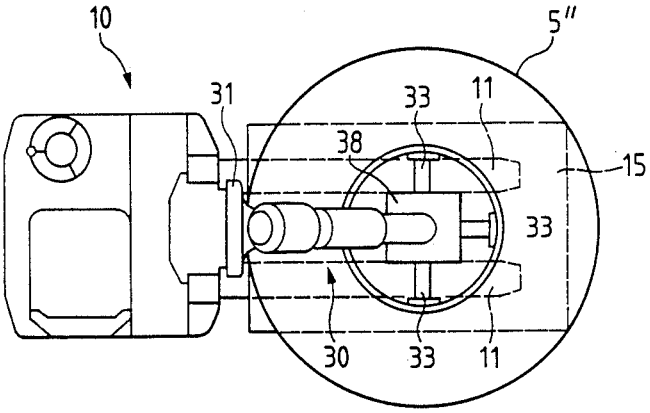

FIGS. 4A and 4B show the pallet loading process in a more advanced stage. On the bottom is located a pallet 15 loaded with a roll 5' and on same truck 10 is ready to place a further roll 5''. The lifting slide 31 is raised on the vertical rail 12 and the pivot pin 35 is rotated by 180° compared with FIG. 2A, i.e. roll 5'' is pivoted into the horizontal position. Roll 5'' is held by the receiving lug 38 and can now be vertically lowered. As soon as roll 5'' rests on the lower roll 5', the receiving lug, whose detailed construction has not yet been shown, can be brought out of the expanded or spread-apart position into the release position and drawn out of the roll core 6. FIG. 4B shows the industrial truck 10 with its claws 11 placed under pallet 15 and the roll 5'' hanging on manipulator 30 from above. It is diagrammatically possible to see the spreading arms 33 of the receiving lug 38 braced in the roll core 6. The arrangement of said spreading arms 33 or a corresponding holding means is such that roll 5 can easily be disconnected in the desired position, i.e. vertical or horizontal. When using the manipulator in conjunction with storage frames or the like on which the rolls are to be suspended on the roll core 6, it must also be borne in mind that the holding means 33,38 is matched to the suspension means, i.e. has spreading arms 33 displaced with respect to the corresponding holding members.

Figure 5:
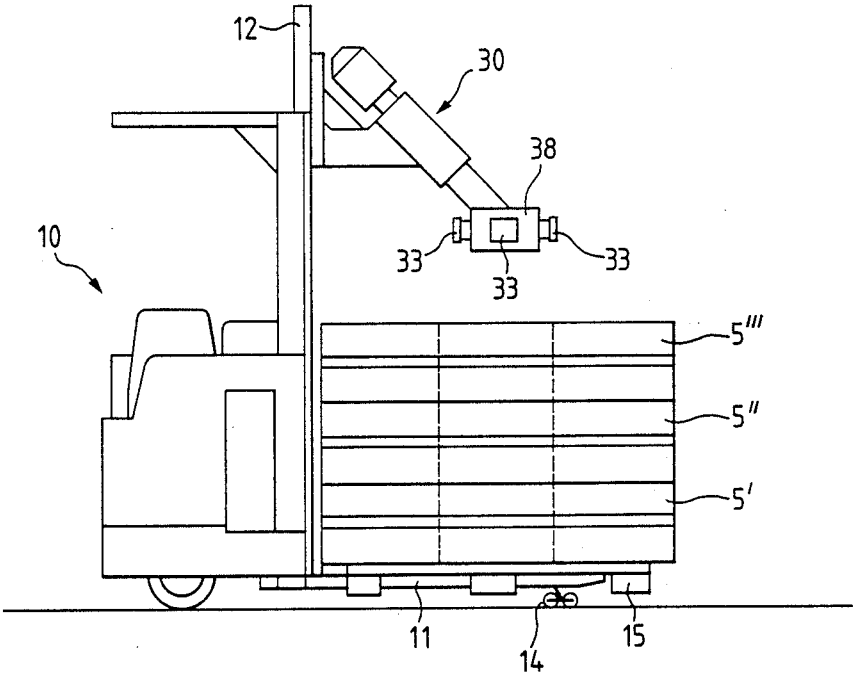
FIG. 5 shows the e.g. completely loaded means with raised pallet in the position for taking away the loaded rolls.

It is now possible to show the novel possibility of the means according to the invention. After placing roll 5'' on roll 5' already located on the pallet, as shown in FIG. 2A, the truck can either move away from the pallet 15 standing on the floor in order to collect a further roll, or the claws 11 equipped with an initial stroke device 14 can rise with the pallet and can move away with the latter. This is shown in FIG. 5, in which the truck 10 is loaded with three rolls 5', 5'', 5''' and with the pallet raised is movable either to the next winding machine to load a further roll, or can travel to a storage location, where the rolls can be stored up to the time of further processing. As a function of the height of the vertical rail 12 and the carrying and lifting force of device 14 for the initial travel, a pallet 15 can be loaded with a large number of rolls 5. Manipulator 30 with its holding means 33,38 is raised to above the top roll. For special uses, where e.g. the top roll is to be taken by another handling means directly from the loaded truck 10, the manipulator 30 can also be pivotably fixed to the truck. In this way the manipulator can, if necessary, be pivoted and consequently does not impede the other handling means.

The aforementioned traffic problem can be solved as a result of the possibility of carrying around a pallet which is to be loaded, so that it can be ultimately transported to its storage location Thus, such a vehicle is able to travel between the individual winding stations and take the heavy rolls from the machine and place them on the pallet carried along with it. In the case where the vehicle with the carried along pallet cannot be moved so close to the winding machine as to enable it to lift the finished roll with the receiving lug, then it can set down the carried pallet in the vicinity of said machine and travel the remaining short distance to the winding machine in the unloaded state.

The resulting possibility of reducing working processes and the otherwise unavoidable, but still unnecessary travelling or driving maneuvers, results from the capacity of the being able to load a carried along pallet, which can be set down at any time. This is achieved through the cooperation of two functions, namely the combination of an industrial truck with raisable claws and a handling means able to carry out the desired manipulation. In this example the manipulator is constituted by a means able to raise rolls of wound printed products weighing several hundred kilograms from the winding machine and place same on a pallet. However, naturally other manipulating functions or holding means for many other products are conceivable.

Figure 6A:
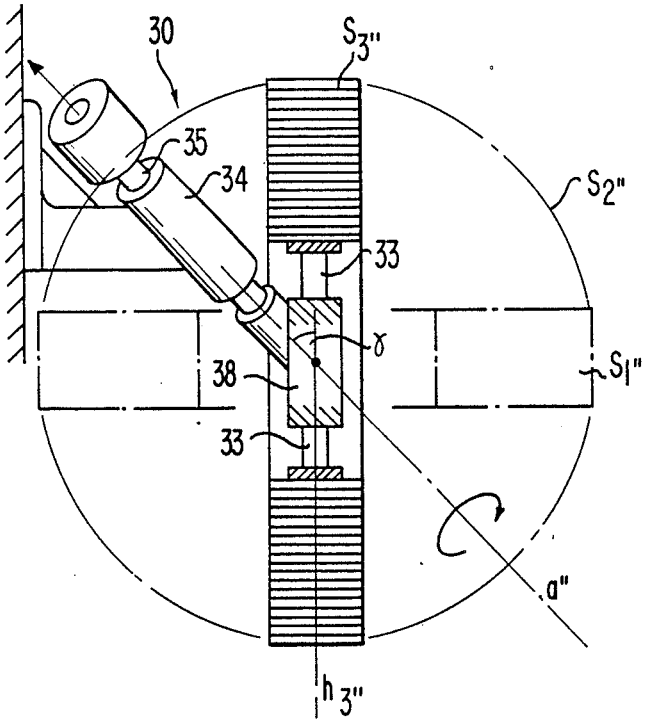
FIG. 6A and 6B are an elevation and plan view of a manipulator with the three possible main load positions orthogonal to one another.
Figure 6B:
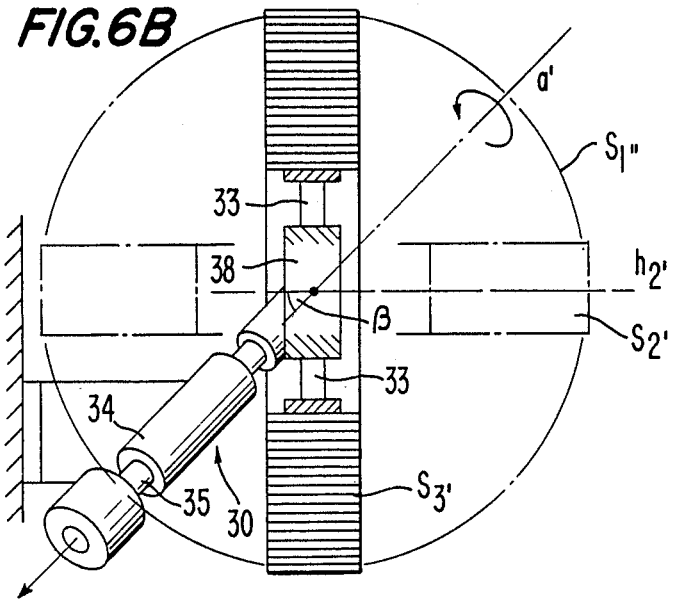

The arrangement of the manipulator, as described relative to FIGS. 2, 4 and 5, only permits two main positions of the roll core. In order to achieve the third main position whilst only limiting to a single pivot pin, the manipulator is inventively arranged in accordance with the concept shown in FIGS. 6A and 6B. Without a model, it is not easy to understand the spatial tumbling movement of the roll in the desired positions due to the special spatial, reciprocal arrangement of pin or axle 35 and holding means 33,38, but this leads to the surprising possibility of permitting three main load positions perpendicular to one another with only a single degree of rotational freedom. FIG. 6A is an elevation and FIG. 6B the corresponding plan view of manipulator 30. Pivot pin 35 is rotatably held in the bearing guide 34 and is directed in such a way that its projection a ′ in a first principal plane forms an angle beta of 45° with a second principal plane $h_2'$ and its projection a″ om the second principal plane forms an angle gamma of 45° with a third principal plane $h_3''$, the three principal planes being orthogoanlly related. Positions $S_1'$, $S_2'$ and $S_3'$ of a roll 5 are shown. Starting from a basic position $S_1$, where such a roll is horizontally positioned, i.e. is parallel to the first principal plane, axle 35 is rotated by −90° so that the roll comes into an upright position $S_2$, parallel to the second principal plane. On rotating the roll starting from the "lying" basic position $S_1$ by +90°, then the roll is upright and parallel to the third principal plane. Thus, through rotations of 90° or 180° the load can be pivoted from each position into another main position at right angles thereto. Thus, the inventive problem of achieving with the manipulator three main load positions orthogonal to one another is solved. Obviously the intermediate positions traversed during the tumbling movement where the roll is inclined with respect to the principal planes, could be significant for special applications, e.g. if the roll is to be inclined by 45° with respect to second and third principal planes.

In place of a long pin or axle 35, it is also possible to fit an axle journal or joint of a support arm provided in place of guide 34. This does not impair the inventive concept of a very force-free tumbling movement about a rotation axis or point.

Figure 7A:
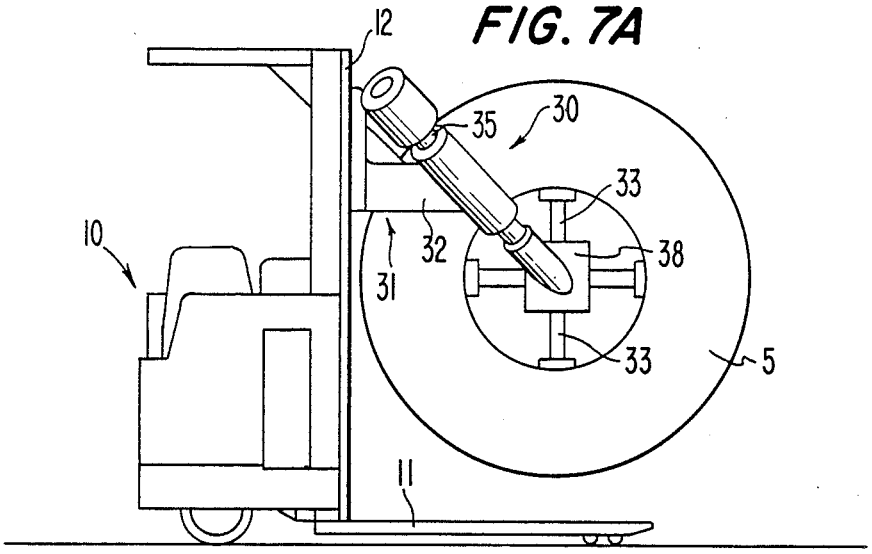
FIGS. 7A and 7B show the manipulator according to FIGS. 6A/B used with a truck having a lifting means from the side and from above.
Figure 7B:
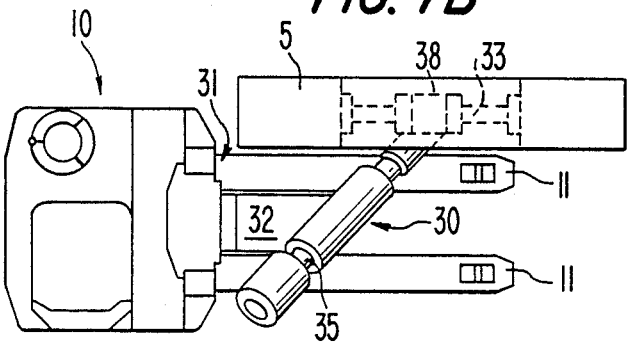

Once again in connection with the example of a printing plant, FIGS. 7A and 7B show a loading process, in which the roll can be raised laterally instead of frontally from the winding machine. The industrial truck 10 with the two claws 11 is equipped with a manipulator, as described relative to FIGS. 6A and 6B. By means of a support arm 32 the manipulator 30 is arranged on a lifting slide or carriage 31, which can be heightwise adjusted on a vertical rail 12 fitted to truck 10. The rotation axis slopes forward, to the left and downwards as seen from the rear of truck 10. The length of the rotation axis for the distance between the holding means 33,38 and the vertical median longitudinal plane of the vehicle is chosen in such a way that the truck can be moved without difficulty up to the stored rolls. It is also possible to displace the manipulator 30 or vertical rail 12 with respect to the median longitudinal plane of the vehicle, so that the rolls can be gripped or set down with a larger lateral spacing from the vehicle. If the manipulator is used together with claws or another transportation means such as a bearing surface, and if said lateral displacement is too great, precautions must be taken in connection with the placing of the rolls on the claws. This can e.g. be achieved by making the manipulator pivotable about a vertical axis or by providing a translatory lateral movement of the lifting slide. Another possibility consists of pivoting or laterally displacing the lifting means or to provide laterally extendable arms or beams thereon.

In the case of the combination of the manipulator and claws or other transportation holding devices, particularly if loads are to be gripped or set down at a large lateral distance from the vehicle, it is possible to provide a mounted implement 20 of the type shown in FIGS. 8A to 8C. The mounted implement is e.g. operable by hydraulic drive 46. The support arm 25 is pivotably constructed, so that the roll can be horizontally pivoted, as shown in FIGS. 8B and 8C. This makes it possible to grip or set down a roll 5 at a considerable distance d from the median longitudinal plane m of the vehicle. In order to be able to set down the roll on the claws 11 of truck 10, the mounted implement is rotatably arranged in a pivot bearing 27. To the latter can be fitted a lifting slide 24, to which is fitted the support arm 25 and which is in turn provided with a receiving lug 28, so that it can be rotated about its own axis. Thus, a roll 5 fixed to the receiving lug can either be taken directly from the winding machine or from a support and can be pivoted from the indicated vertical position into a horizontal position, as shown in FIG. 7A. If roll 5 is rotated about the pivot bearing 27 in a position of support arm 25 according to FIG. 8B, the necessary torques can be minimized because the centre of gravity of the heavy rolls 5 comes to rest close to the rotation axis. The roll is then rotated in a horizontal position, so that it can be lowered onto the pallet on the claws.

As has already been stated, the advantage of this combination is the saving of travel paths or maneuvers and this also leads to a noticeable time and energy saving. As a result of the reduced number of single trips the traffic problems are reduced, i.e. the vehicles used can travel more efficiently and it is also possible to use more vehicles. The trucks according to the invention are particularly suitable for use in production lines, because as a result of being self-loadable and carrying collected products round with them, they have to carry out fewer "return paths". The inventive combination is also advantageous in stores having dead-ends and gorges. Although most mounted implements have improved efficiency as a result of the vehicle pallet transportability, the use of the inventive manipulator in the printing field is the most advantageous.

In place of a pallet, it is fundamentally possible to use any other transportation holding means, e.g. a raisable platform on which a pallet can be placed. This is because part of the load to be transported, can so-to-speak be stored on an accompanying platform, thereby obviating travel paths, which would be necessary in the case of single transportation operation. However, the most universal of all the variants is that using pallet-compatible claws with an initial stroke.

Another use of the manipulator according to the invention is in conjunction with a crane. If heavy loads, preferably the aforementioned rolls from a printing works, are to be raised over considerable heights and also moved, e.g. in automated stores with several storage planes, the use of industrial trucks is less appropriate, because then the corresponding vertical rail for the vertical adjustment of the manipulator would have to be constructed too long or massive. Consideration should also be given to the use of a crane if the use of such trucks is not practical, e.g. in the case of very confined space conditions, as well as uneven or staged floor surfaces and the like.

The problem in connection with gripping and holding devices on cranes is that they are generally suspended on one or more cables and can therefore only take up small or no torques. For gripping large, heavy loads consideration must therefore be given to means having larger swivel arms. The inventive manipulator with only one pivot pin is in this connection ideal. An embodiment of a manipulator for a crane is diagrammatically shown in FIg. 9. Manipulator 50 is coupled via a support structure 55 to the holding device 51, which is in turn suspended on cables 57. The support structure 55 and manipulator 50 are arranged in such a way that the pivot point 53 is essentially positioned vertically below the holding device 51, which ensures that the centre of gravity, which essentially coincides with the pivot point with the device loaded, i.e. holding a roll weighing several hundred kilograms, exerts no torque on the cables 57. If the centre of gravity of the means in the unloaded state must be positioned vertically below the holding device 51, e.g. in the case of a massive or solid construction of the support structure and the manipulator, a preferably adjustable counterweight 54 can be provided. Thus, it is possible in simple manner to adapt the crane to loads of different weights. As the roll centre of gravity during the complete movement of a roll 5, which is diagrammatically shown by broken lines in different positions, is located in the pivot point 53, no torques are exerted on cables 57, which makes it possible to bring even very heavy loads into different spatial positions by rotating about the rotation axis 52. In conjunction with a crane, a construction of the manipulator without a drive and only a handle is advantageous.

Another embodiment of the invention is shown in FIGS. 10A and 10B. A fixed support arm 61 is fixed to a lifting slide or a mounting plate 59 under an angle of 45° with respect to the perpendicular and a projection angle of 45° with respect to a second principal plane. Unlike in the case of the above-described construction, the support arm arranged at 45° is rigid and has no pivot pin. Instead a joint 67 is provided on the free end of support arm 61. In order to bring about the minimum frictional resistance, the pivot point is formed by a ball or universal joint 67. This construction makes use of the favourable arrangement of the support arm with the corresponding angles of 45° and the fact that the pivot point of the load coincides with the centre of gravity. Through the use of a joint, two rotational degrees of freedom are provided, but this arrangement is more complicated and more prone to wear. By means of two hydraulic cylinders which are connected to the support arm or mounting plate, as well as to the holding device 68, roll 5 can be moved about the pivot point and its spatial position can be changed.

In order to extend the field of use of the manipulator, it is possible to provide further pivot pins making it possible to grip loads from other working positions. For example, support arm 32 or the lifting slide can be constructed in a rotatable or articulated manner. This makes it possible to modify the angle gamma of the pivot pin 35 or to bring the manipulator into a different spatial position (FIG. 7).

It is pointed out that the balanced suspension of the load in the centre of gravity also makes it possible for a person to manually move the raised load. This can e.g. be necessary in the case of very difficult suspensions, if e.g. a roll must be very precisely guided on a holding device. An embodiment with an handle 63 is shown in FIGS. 11A and 11B. A fixed support arm 61 is fixed under a position angle of 45° with respect to the perpendicular and a projection angle of 45° with respect to a second principal plane to a mounting plate 59. In order to bring about minimum frictional resistance, the pivot point is formed by a ball or universal joint 67. Preferably the joint 67 has an axial guide, e.g. a guide notch for a joint ball, so that the operation of handle 63 leads to a rotation of the load about the longitudinal axis of the support arm 61, which leads to the aforementioned tumbling movement. In order to be able to precisely determine the end positions of roll 5, it would also be possible to provide stops 66 on mounting support 68, which would define said end positions. It is obviously also possible to provide such a handle in addition to a drive and in the case of manual operation the drive can e.g. be disengaged.

Thus, the manipulator can be used in conjunction with a simple frame on rollers without a drive and without a motor support for the handling process. The vertical adjustment of the manipulator can take place by a hydraulic means operated in a manual manneer and the desired position of the roll can be obtained manually through a substantially force-free tumbling movement about the centre of gravity.

It is obviously also possible to arrange the manipulator in such a way that the pivot pin slopes upwards instead of downwards. This would make it possible to suspend the load in a horizontal position on a device. In combination with the rotational possibility of the manipulator about a horizontal axis, it is still possible to load the pallet and it is consequently possible to extend the range of use of the handling means.

The novel construction of the manipulator with a pivot pin or a support arm inclined by 45° makes it possible to simply grip large loads, e.g. rolls with a diameter up to 2.5 m and also to manipulate high weights, because the construction of the manipulator does not lead to large lever arms and consequently to excessive loading.

Another use of the manipulator is in conjunction with an industrial truck, whereby the manipulator is arranged laterally on the vehicle and not in front of the same in the direction of travel. This makes it possible in very simple manner to grip rolls or other loads from dead-ends in stores. If a pallet is also transported by the truck and the gripped rolls are to be stacked thereon, it is possible to arrange the manipulators so that it rotates about a vertical axis, so that after gripping a roll can be swung over the pallet and then placed thereon.

It is obvious that through the combination of the inventive manipulator with further means permitting additional degrees of freedom and/or by the special arrangement on the truck or crane, it is possible to considerably increase the possible uses. The advantage of the simple, stable construction of the manipulator makes it possible to use such additional means, without having to accept reduced strength and stability.

The different positions of the load can be obtained through a given control with two or three clearly defined positions. For uses where intermediate positions of the load are to be adjustable, it is possible to provide a step or programmable control or the like.

I claim:

1. A manipulator for handling a heavy load, the load being of a type having a surface defining an opening into and from which a manipulator member can be inserted and removed and wherein the center of gravity of the load is located in the opening, the manipulator comprising the combination of a pivot pin having a central axis;

holding means insertable into the opening in said heavy load for engaging said surface defining the opening in said load;

means for attaching said holding means to one end of said pivot pin with said holding means at the center of gravity of said load when said holding means engages said surface such that said holding means is rotatable about said central axis of said pivot pin and so that rotation of said holding means about said central axis causes rotation of said load about its center of gravity; and mounted means including a vehicle having a longitudinal axis for rotatably holding said pivot pin with said central axis of said pivot pin at a first predetermined angle between zero and ninety degrees with respect to a horizontal plane and a second predetermined angle between zero and ninety degrees with respect to a vertical plane containing said longitudinal axis of said vehicle whereby rotation of said pivot pin moves said holding means and said load through three orthogonal positions.

2. A manipulator according to claim 1 wherein each said predetermined angle is between 30° and about 60°.

3. A manipulator according to claim 2 wherein each said predetermined angle is about 45°.

4. A manipulator according to claim 2 wherein said mounting means includes a support arm extending parallel to a vertical plane through the longitudinal axis of said vehicle and said pivot pin slopes downwardly in the direction of normal, forward motion of said vehicle to said holding means.

5. A manipulator according to claim 1 wherein said holding means is rigidly connected to said one end of said support arm and said mounting means includes a bearing rotatably supporting said pivot pin.

6. A manipulator according to claim 5 wherein said holding means includes at least one hydraulically operable spreading arm for engaging said load.

7. A manipulator according to claim 1 wherein said holding means has a central axis forming an angle of about 45° with said central axis of said pivot pin.

8. A manipulator according to claim 1 wherein said vehicle is an industrial truck having means thereon in addition to said manipulator for lifting loads.

9. A manipulator according to claim 8 wherein said mounting means includes a vertical rail structure on which said support arm is vertically movable.

* * * * *